US008290188B2

(12) United States Patent
Suurballe

(10) Patent No.: US 8,290,188 B2
(45) Date of Patent: Oct. 16, 2012

(54) HEARING AID AND A METHOD OF OPERATING A HEARING AID

(75) Inventor: Morten Suurballe, Ballerup (DK)

(73) Assignee: Widex A/S, Lynge (DK)

( * ) Notice: Subject to any disclaimer, the term of this patent is extended or adjusted under 35 U.S.C. 154(b) by 296 days.

(21) Appl. No.: 12/815,654

(22) Filed: Jun. 15, 2010

(65) Prior Publication Data

US 2010/0246865 A1 Sep. 30, 2010

Related U.S. Application Data

(63) Continuation-in-part of application No. PCT/DK2007/000552, filed on Dec. 19, 2007.

(51) Int. Cl.
*H04R 25/00* (2006.01)

(52) U.S. Cl. ..... 381/315; 381/312; 381/314; 381/323

(58) Field of Classification Search ..... 381/312, 381/314, 315, 323
See application file for complete search history.

(56) References Cited

U.S. PATENT DOCUMENTS

| | | | | |
|---|---|---|---|---|
| 6,229,900 | B1 | 5/2001 | Leenen | |
| 6,785,394 | B1 * | 8/2004 | Olsen et al. | 381/312 |
| 6,952,621 | B1 * | 10/2005 | Malcolm et al. | 700/94 |
| 6,980,056 | B1 * | 12/2005 | Alexander et al. | 330/284 |
| 2002/0097883 | A1 * | 7/2002 | Foley | 381/58 |
| 2005/0078846 | A1 | 4/2005 | Single | |
| 2005/0105751 | A1 | 5/2005 | Arz et al. | |
| 2007/0274549 | A1 | 11/2007 | Husung | |
| 2010/0246865 | A1 * | 9/2010 | Suurballe | 381/314 |

FOREIGN PATENT DOCUMENTS

| | | | |
|---|---|---|---|
| CH | 680250 | A5 | 7/1992 |
| DE | 102006024713 | B3 | 8/2007 |
| EP | 1341380 | A1 | 9/2003 |
| EP | 1519623 | A2 | 3/2005 |
| JP | 11-69499 | A | 3/1999 |
| JP | 2007-221397 | A | 8/2007 |
| WO | WO 2009076949 | A1 * | 6/2009 |

OTHER PUBLICATIONS

International Search Report for PCT/DK2007/000552—Mailing Date Apr. 24, 2008.
Office Action dated Jul. 10, 2012, for Japanese Patent Application No. 2010-537254 with English translation.

* cited by examiner

*Primary Examiner* — David S. Warren
(74) *Attorney, Agent, or Firm* — Sughrue Mion, PLLC

(57) ABSTRACT

A hearing aid (1) has means for entering or leaving a stand-by mode initiated by a remote control (14). During use, a dedicated stand-by command issued by the remote control is received and decoded in the hearing aid. When a stand-by command is recognized, a clock signal to the signal-processing parts (3) of the hearing aid (1) is disabled, effectively halting the signal processing. In the stand-by mode, the hearing aid circuitry draws very little power from the battery. Reception of a similar command in the hearing aid during the stand-by mode enables the clock signal to the signal-processing parts of the hearing aid, enabling signal processing. A method to manage the stand-by mode involves the step of calling a soft-boot routine when the hearing aid leaves stand-by mode and resumes normal operation.

8 Claims, 3 Drawing Sheets

HEARING AID AND A METHOD OF OPERATING A HEARING AID

RELATED APPLICATIONS

The present application is a continuation-in-part of application No. PCT/DK 2007000552, filed on Dec. 19, 2007, in Denmark and published as WO2009076949 A1.

BACKGROUND OF THE INVENTION

1. Field of the Invention

The present application relates to hearing aids. More specifically, it relates to battery powered hearing aids comprising remote control receivers. The invention further relates to a method of operating a hearing aid. The invention also relates to a hearing aid system comprising a hearing aid and a remote control.

Present-day hearing aids are powered by tiny battery cells, preferably of the zinc-air variety. Zinc-air battery cells comprise a zinc anode, an aqueous alkaline electrolyte and an air cathode. Power is derived from the chemical reduction of oxygen, derived from the surrounding air, at the cathode, and the oxidation of zinc at the anode. Such a cell has the advantages of a very high power density, a comparatively constant power profile, and an environmentally friendly chemistry. The alkaline electrolyte in the cell is protected from the surrounding atmosphere by an airtight seal until employment, when the seal is broken prior to placing the cell in the battery compartment of the hearing aid, and the cell starts providing electrical power to the hearing aid.

The battery seal is usually embodied as a small label attached to the cathode of the battery cell, and the cathode terminal has tiny holes placed below the label to allow air to enter the interior of the battery cell when the label is removed. When air comes into contact with the electrolyte inside the battery cell, the electrochemical reaction is initiated, and an electric voltage difference is built up and maintained between the battery cell electrodes for the duration of the electrochemical reaction inside the cell. The typical voltage of a zinc-air battery cell is from 1.1 V to 1.4 V.

If left disconnected from any circuitry, and thus being without any external load after the seal is broken, the zinc-air battery cell is slowly depleted by a process known as self-discharging, and the cell will eventually lose its power over the course of a couple of days. This self-discharging is mainly the result of the electrolyte in the cell drying up, but other factors, like high humidity, or the presence of oxygen or carbon-dioxide in the vicinity of the cell, also affect the rate of self-discharge.

2. Prior Art

A common procedure for turning off a battery-powered hearing aid when not in use is by disconnecting the battery cell from the hearing aid circuitry, either by means of a power switch or by dislocating the cell itself from at least one of the battery terminals of the hearing aid, thus opening the electric circuit. Hearing aids may also employ a double-pivoted, swiveling battery compartment assembly in order to provide both a battery dislocation function for turning the hearing aid on or off, and an opening function for replacing the battery cell.

Both mechanical switches and battery terminals in hearing aids are prone to wear when the hearing aid is turned on and off many times. Battery terminals and contact elements of switches are preferably made from spring steel or phosphor bronze bent into the desired shape and subsequently gold-plated in order to prevent corrosion, but the physical dimensions of the hearing aid severely limit the obtainable durability of mechanical switches and battery terminals within the hearing aid, and the double duty performed by the battery compartment assembly, i.e. when changing the battery cell and when powering the hearing aid on and off puts a considerable amount of stress upon the battery terminals.

Electronic power switches are used in many types of electronic devices, usually in the form of a semiconductor element controlling the power circuit of the electronic device relying on a trigger impulse from a switch or the like. This type of circuit has a prolonged service life when compared to similarly employed mechanical switches, but it draws a modest amount of leakage current while the device is switched off. In a hearing aid, where the available power is limited, any significant leakage current would obviously shorten the service life of the cell, and an electronic power switch of this kind is thus a good choice for employment in a hearing aid.

Due to the dimensional restrictions mentioned in the foregoing, any switches in the hearing aid have to be made very small in order to fit into the hearing aid casing. Apart from being prone to wear and breakage, tiny mechanical switches may also be difficult to operate properly, e.g. by physically disabled hearing aid users. Power switches operated by dislocating the battery cell from the battery terminals of the hearing aid may also result in the cell falling out of the battery compartment by accident and eventually getting lost as the result of an erroneous operation by the user.

Remote control devices for use with hearing aids are known. They offer a convenient way of operating various user-accessible features of a hearing aid such as volume level and program selection, but they still require the hearing aid to be switched on in order to receive and process the commands transmitted from the remote control device.

An active command for controlling the power in a hearing aid from a remote control device is not easily employed. Obviously, if all circuitry in the hearing aid is powered off, no means for powering the hearing aid back on again by a corresponding command from the remote control device would have any effect. However, if only parts of the circuitry were powered off by such a command, i.e. all but the parts responsible for receiving and interpreting commands from the remote control device, the hearing aid could be cycled between a normal mode of operation, drawing full power from the hearing aid battery cell, and a stand-by mode, drawing very little power from the battery cell.

By definition, a stand-by mode of an electronic device is a mode of operation in which the electronic device consumes very little power when compared to the power consumption during normal operation, and from which mode the device may be brought into normal operation by performing some special action, e.g. activating an 'on'-function, either directly by interacting with the circuitry of the electronic device, for instance by pushing a button or activating a switch, thus closing part of the circuit, or indirectly by transmitting a predetermined signal from a distance to a receiver located within the electronic device and being capable of interacting with the circuitry of the electronic device upon reception and detection of the predetermined signal, said receiver remaining active during the stand-by mode.

DE-B3-102006024713 proposes a hearing aid having means for detecting the presence of a passive, resonant circuit, comprising a capacitor and an inductor, in close proximity to the hearing aid. In one embodiment, the hearing aid has means for switching off its power when located close to the resonant circuit, e.g. when the hearing aid is placed in its storage box, the storage box having said resonant circuit embedded into its bottom wall. The means in the hearing aid for detecting the presence of a passive circuit comprises a transmitter and a transceiver coil. A part of the hearing aid is thus being disabled whenever the hearing aid is placed in its storage box. When the hearing aid is removed from the storage box, the power is reapplied to the disabled parts of the hearing aid.

The transmitter in the hearing aid according to the prior art emits short bursts of electromagnetic energy at the resonant frequency of the passive circuit through the transceiver coil, even when the hearing aid is supposed to be powered off. The electromagnetic energy excites the passive circuit to oscillate at the resonant frequency. While the passive circuit oscillates, it dissipates the absorbed energy as electromagnetic waves. These electromagnetic waves may then be picked up by the transceiver coil and detected by the hearing aid circuitry.

The range of a secure detection of the presence of a passive resonant circuit is limited by the amount of energy the transmitter is capable of dissipating. This puts a serious constraint to the detection range of the system, as the energy transmitted follows the inverse square law, i.e. the electromagnetic energy dissipated by the transceiver coil and the energy reflected back to the transceiver coil by the passive circuit decreases with the distance squared.

Taking the limited energy available in the hearing aid battery into account, the effective range for detecting a passive circuit by a transmitter in a hearing aid is, at the very best, only a few centimeters. When the transmitter in the hearing aid has to operate continuously in order to detect the presence of the passive resonant circuit, a considerable amount of current is consumed by the hearing aid even when it is supposed to be powered off.

Wireless receivers for controlling a stand-by mode may comprise receiver types capable of detecting acoustical, optical or electromagnetic signals generated by a suitable, corresponding transmitter. Acoustical transmission usually involves ultrasonic transducers unsuitable for use in a hearing aid due to limitations in size and power requirements. Optical transmission usually involves low-power infrared light emitting diodes, but such designs are dependent of a clear line-of-sight between the transmitter and the receiver, difficult to obtain in hearing aids being worn behind or in a user's ear.

Electromagnetic transmission, on the other hand, is well suited for use in low-power applications, as the power requirements of an electromagnetic receiver can be designed to be very low indeed. A transmitter may also be carried out of the line-of-sight as long as the receiver is within the detection limit. Electromagnetic remote control signals may further be modulated in a variety of ways suitable for the intended use, but a discussion of modulation techniques is beyond the scope of this application.

A hearing aid capable of entering a stand-by mode initiated by a remote control from a range of one to one-and-a-half meter would be desirable. Furthermore, a stand-by mode having the hearing aid drawing very little power from the battery cell within the hearing aid would be even more desirable.

SUMMARY OF THE INVENTION

It is a preferred feature of the invention to provide a hearing aid with a stand-by mode functionality with a sufficiently low power requirement in order to conserve battery power whenever the hearing aid is not in use.

It is another feature of the invention to provide a hearing aid capable of entering or leaving a stand-by mode by receiving corresponding commands from a remote control device.

It is a further feature of the invention to provide a method of activating or deactivating part of the circuitry in a hearing aid from a distance by using a remote control device.

The invention, in a first aspect, provides a hearing aid comprising a power source, at least one input transducer, an analog/digital converter, a digital signal processor, a clock generator, an acoustic output transducer, and a remote control receiver, wherein the remote control receiver comprises means for controlling a connection between the clock generator and the digital signal processor to provide changing between a power-on mode and a stand-by mode according to a signal received by the remote control receiver, said means for controlling a connection comprising a controller and a switch, the switch being embodied as a semiconductor switching element, and said controller being adapted to perform a soft-boot sequence on changing from the stand-by mode to the power-on mode.

The hearing aid is capable of being operated in a 'normal' mode of operation, where signals picked up by the microphone are processed and reproduced by the hearing aid output transducer, and in a stand-by mode of operation, where incoming signals are not processed or reproduced by the hearing aid output transducer. Both modes may be activated by a remote control. The stand-by mode requires significantly less power than normal operation, since a major part of the hearing aid circuitry is inoperational.

In a preferred embodiment of the invention, the signal for controlling the connection between the clock generator and the digital signal processor originates from a wireless remote control. The external signal may be thus transmitted from a distance of up to about 1.5 m. This distance is accomplished by having a sufficiently powerful transmitter placed in the remote control. The remote control may then put one or two hearing aids in either the stand-by mode or in the mode of normal operation in a confident and reliable manner from a distance of e.g. an arm's length by the hearing aid user.

In an alternate embodiment, the external signal originates from a programming device. In this way, the hearing aid may, if needed, be put into the mode of normal operation prior to programming, the parts of the hearing aid comprising means for storing the programming information being shut off in the stand-by mode.

In a further embodiment, the signal originates from a dedicated switch on the hearing aid itself. This enables the hearing aid to be put in the stand-by mode by the user of the hearing aid in cases where the hearing aid does not feature a remote control, e.g. due to space considerations in the hearing aid casing, a remote control receiver requiring a receiver coil etc. in order to work.

The invention, in a second aspect, provides a method of operating a hearing aid, comprising the steps of powering on the hearing aid, loading a hearing program into a signal processor, processing a signal according to the hearing program, receiving, decoding and processing a remote control command, responding to a stand-by command from the remote control by entering a stand-by mode, the step of entering the stand-by mode comprising disabling the flow of a clock signal to dedicated parts of the hearing aid, and responding to a power-on command from the remote control by enabling the flow of the clock signal to said dedicated parts of the hearing aid and calling a soft-boot algorithm.

This method handles stand-by commands separately from all other commands, such as volume changes, program changes etc., sent to the hearing aid. In this way stand-by commands are given a high priority, decreasing the possibility of entering the stand-by mode by accident. Acknowledgement of commands are protected from error by a cyclic redundancy check prior to decoding.

According to a preferred embodiment, the method further involves the step of calling the soft-boot algorithm when the flow of the clock signal is re-enabled, putting the hearing aid in a state resembling the state when the hearing aid is first turned on. This ensures that no signal residue is presented to the hearing aid user when leaving the stand-by mode and resuming normal operation, and protects the hearing aid processor against entering an undefined state or an infinite, uncontrollable program loop.

The electronics in a hearing aid has to be very small in order to fit behind—or even in—a person's ear. The majority of necessary electronic components in a typical hearing aid are thus embodied as one or more integrated circuits comprising the thousands of semiconductor elements together making up the hearing aid circuitry, bar a few components external to the integrated circuits such as large capacitors, resistors, telecoils, receiver coils etc. In a digital hearing aid, most of the integrated circuit comprises MOSFET transistors or similar semiconductor elements each operated in either an "open" (isolating) or a "closed" (conducting) state according to their function in that specific part of the integrated circuit.

These semiconductor elements, which may be compared to tiny voltage controlled switches, have the property of drawing very little current when being in one of these states, but they draw a comparatively large amount of current when switching from one state to another. A clock generator usually caters for the timing of the switching of the semiconductor elements together performing the operations of the digital hearing aid circuit. The clock generator is thus potentially controlling the switching of many of the semiconductor elements several millions of times per second.

Every time one semiconductor element switches from one state to another, current is drawn from the battery cell, and if some of the semiconductor elements are connected in such a way as to retain the same state over time, this portion of the semiconductor elements does not draw any significant current when compared to the rest of the semiconductor elements in the circuit. As the clock generator controls the switching of the semiconductor elements in a digital hearing aid circuit, means for temporarily disabling the clock signal otherwise fed to a dedicated part of the circuit will effectively inhibit the operations in this dedicated part of the circuit, thus saving the power consumed by this part of the circuit.

The invention, in a third aspect, provides a hearing aid system comprising at least one hearing aid and a remote control, which hearing aid has a power source, at least one input transducer, an analog/digital converter, a digital signal processor, a clock generator, an acoustic output transducer, and a remote control receiver having means for controlling a connection between the clock generator and the digital signal processor to provide changing between a power-on mode and a stand-by mode according to a signal received by the remote control receiver, said means for controlling the connection between the clock generator and the digital signal processor including a controller and a switch, the switch being embodied as a semiconductor switching element, said controller being adapted to perform a soft-boot sequence on changing from the stand-by mode to the power-on mode.

BRIEF DESCRIPTION OF THE DRAWINGS

The invention will now be explained in further detail with respect to the drawings, where.

DETAILED DESCRIPTION OF THE INVENTION

Figure 1:
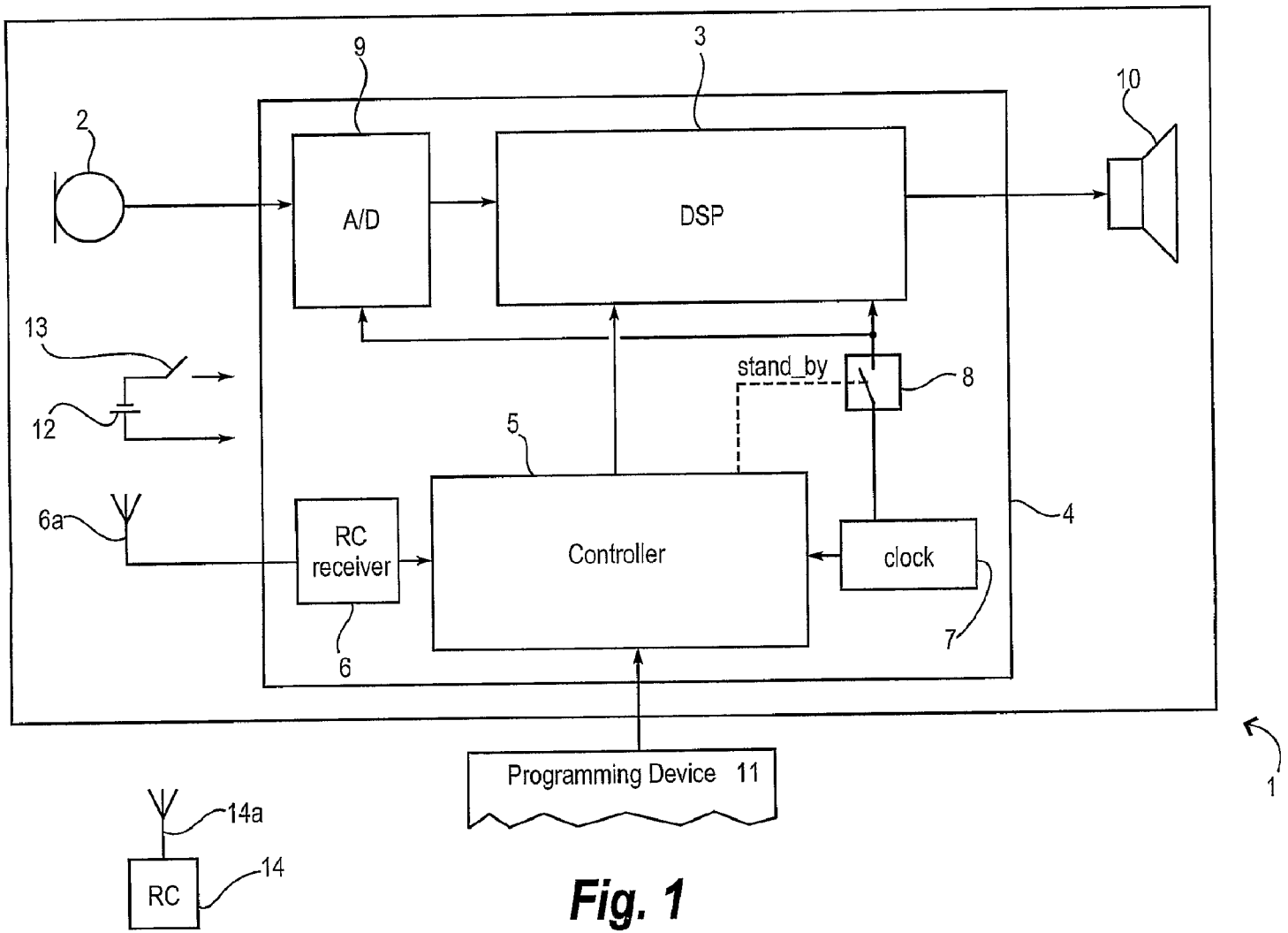
FIG. 1 illustrates a schematic block diagram of a hearing aid according to an embodiment of the invention.

FIG. 1 is a schematic block diagram illustrating a hearing aid 1 comprising a microphone 2, an output transducer 10, a microelectronic circuit 4 comprising an A/D converter 9, a signal processor 3, a controller 5, a remote control receiver 6, a clock generator 7, and an electrically controlled switch 8. The hearing aid 1 further comprises a power source 12, preferably in the form of a battery cell, a mechanically operated battery switch 13, and a receiver antenna 6*a*. Also illustrated in FIG. 1 is a remote control transmitter 14 having a transmitter antenna 14*a*, and an external programming device 11.

When in use, the microphone 2 picks up acoustic signals and converts them into analog electrical signals. The analog electrical signals are converted into digital signals by the A/D converter 9 to make them available for conditioning and amplification by the signal processor 3 according to a compensating prescription in order to alleviate a hearing loss. The signal processor 3 outputs amplified electrical signals for conversion into acoustic signals by the output transducer 10. Wireless signals transmitted from the remote control 14 via the transmitter antenna 14*a* are picked up by the receiver antenna 6*a* and detected by the remote control receiver 6 for operating the hearing aid 1 remotely. Remote control commands include, but are not limited to, program changes, volume adjustments, and the like.

The power source 12, embodied as a battery cell, is connected to the complete hearing aid circuitry (only suggested in FIG. 1) via the battery switch 13, preferably embodied as a pivoted battery compartment capable of detaching the power source 12 from the circuitry of the hearing aid 1 whenever the compartment is opened, for instance when changing the battery cell.

During programming, the hearing aid 1 is connected to an external programming device 11 communicating with the controller 5 of the hearing aid 1. The controller 5 receives prescription parameters for alleviating a hearing loss for a set of different programs (not shown) from the programming device 11 to be stored in memory (not shown) in the hearing aid 1, and utilizes these prescription parameters to adjust the performance of the signal processor 3 according to the prescription.

After finishing the programming of the hearing aid 1, the programming device 11 is disconnected from the hearing aid circuitry 4, and the controller 5 then performs the major tasks of keeping the hearing aid 1 operational, i.e. receiving commands from the remote control receiver 6, changing between the different, stored programs, altering the output volume, adjusting the general performance of the signal processor 3 etc.

The controller 5 also has means for operating the electrically controlled switch 8, which connects the clock generator 7 to the clock input of the A/D converter 9 and the signal processor 3. A stand-by command transmitted by the remote control 14 is received by the remote control receiver 6 and decoded by the controller 5 into an electrical signal for opening the electrically controlled switch 8, thus depriving the A/D converter 9 and the signal processor 3 of the clock signal. As this signal is essential for the A/D converter 9 and the signal processor 3 to operate, the opening of the switch 8 effectively halts all signal processing in the A/D converter and the signal processor and renders the output silent. In practice, the switch is embodied as a semiconductor switching element such as a FET or BJT transistor or a similar, readily available chip design semiconductor element. The choice of a switching element at the design stage is preferably adapted to the technology utilized in the microelectronic circuit 4.

As the signal processor 3 is, by far, the most complex part of the hearing aid circuitry, it may be assumed to consume the highest percentage of the power available from the power source 12. When the hearing aid 1 is processing and amplifying sound, it has a total estimated current consumption of approximately 1 mA. The semiconductor elements in a digital circuit mainly requires power for changing their condition (passing a current or blocking a current), and the clock generator 7 controls the rate by which the individual semiconductor elements of the microelectronic circuit 4 are allowed to change state.

If the clock generator 7 is disconnected from the parts of the microelectronic circuit 4 vital to the processing and reproduction of sounds, i.e. the A/D converter 9 and the signal processor 3 in the block schematic in FIG. 1, no semiconductor element in those parts of the circuit can change its functional state, and the inert parts of the circuit are therefore essentially left in an undefined state until the clock signal is reapplied. All the semiconductor elements in the parts of the circuit deprived of the clock signal only draw an insignificant amount of current in that state, and practical measurements of the current consumption in an existing circuit have shown that sufficient power is saved by entering this non-operational mode for it to be feasible as a dedicated stand-by mode.

As an example, an estimate based on an actual chip design yields the following current consumption results from sections active in stand-by mode:

| | |
|---|---|
| A/D converter: | ~50 μA |
| Remote control receiver: | ~25 μA |
| Clock generator: | ~20 μA |
| Controller: | ~12 μA |
| Total: | ~107 μA |

If the hearing aid in this example consumes 1 mA during ordinary operation, then about 9/10 of the current consumption, or a little less than 900 μA, may be saved in the stand-by mode when compared to the current consumption during ordinary operation.

In one embodiment (not shown) the switching element may be a plurality of switching elements 8 forming part of the clock generator circuit 7 itself. Each part of the hearing aid circuit 4 requiring a clock signal may thus have its own clock signal branch controllable by the plurality of switching elements 8. This enables the clock generator 7 to distribute the clock signals to the rest of the hearing aid circuit in a very flexible manner for optimizing stand-by power consumption.

A typical zinc-air battery cell has a capacity from 40-600 mAh, depending on manufacturer and storage conditions. If a cell with a reasonable capacity of 300 mAh is assumed, then a hearing aid consuming 1 mA may operate continuously for about twelve days on such a battery cell. Based on these assumptions, the hearing aid according to an embodiment the invention may thus comfortably be put in stand-by mode and left in stand-by mode for more than sixteen weeks before the battery cell is depleted. The self-discharge phenomenon depletes an unconnected and unsealed battery during a couple of weeks, but the self-discharge phenomenon may be reduced somewhat by constantly drawing a small current from the battery. This factor is, however, highly dependent of the brand of battery used, as well as other factors.

The hearing aid 1 may be put back into the ordinary mode of operation from the stand-by mode either by issuing a 'soft-boot' command from the programming interface 11 while connected to the hearing aid 1, or by transmitting a power-on command from the remote control 14. In both cases, this command instructs the controller 5 in the hearing aid 1 to close the electrically controlled switch 8 again and execute a 'soft-boot' routine in the hearing aid 1. The closing of the switch 8 allows the clock generator 7 to reapply the clock signal to the A/D converter 9 and the signal processor 3.

The 'soft-boot' routine also puts the signal processor 3 in an initial state corresponding to turning the power of the hearing aid 1 on, thus restarting the signal processor 3 again. This routine is executed for the purpose of eliminating possible signal residues present in the A/D converter 9 or the signal processor 3 prior to entering the stand-by mode, thus reducing the risk of unpleasant clicks or pops being present in the reproduced signal upon leaving the stand-by mode, or the undesirable case of an undefined state being entered during the shutdown phase of the stand-by mode. By performing a soft-boot sequence when leaving stand-by mode, proper signal processing in the hearing aid according to the embodiment of the invention is ensured.

Figure 2:
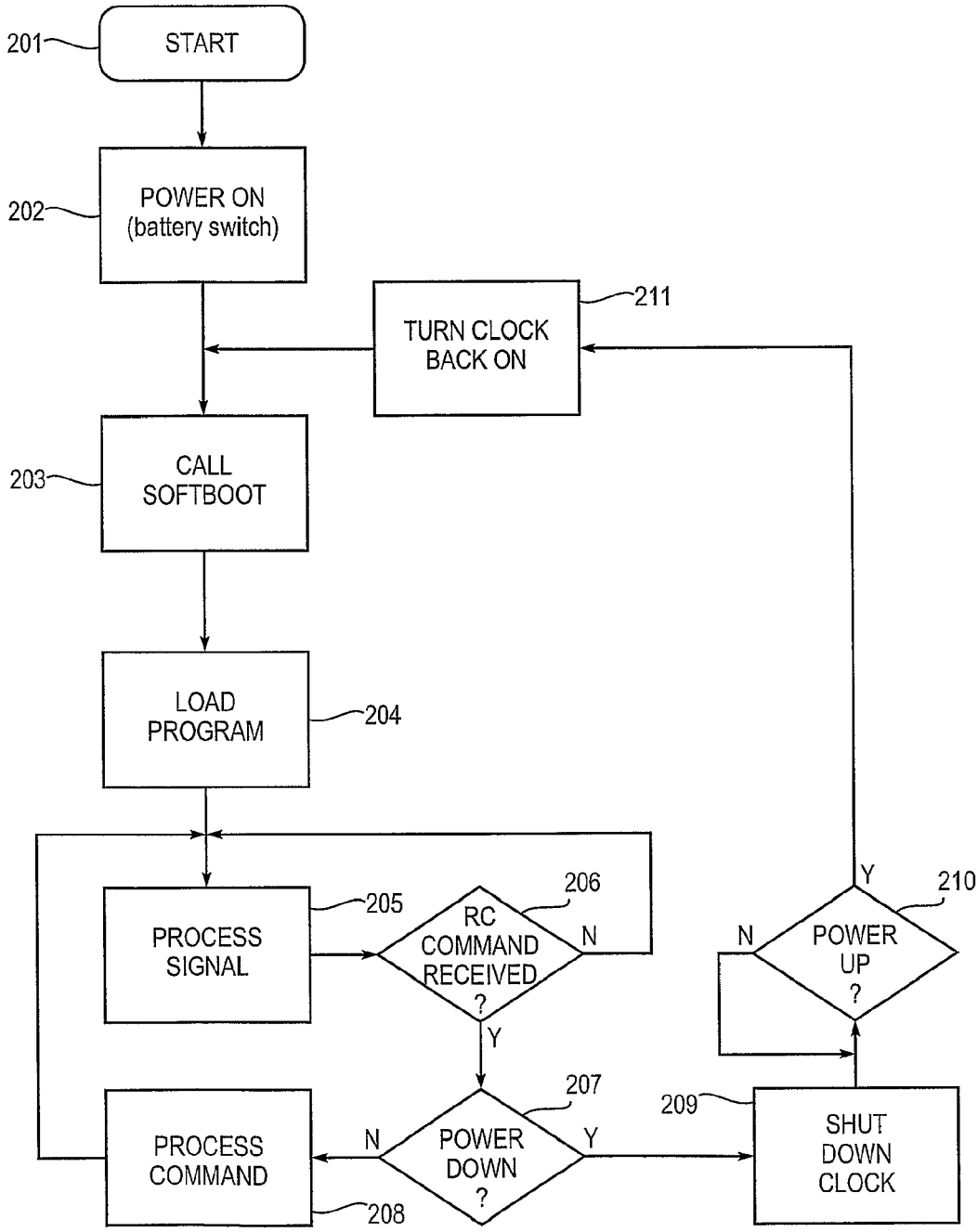
FIG. 2 illustrates a flowchart of a part of the operation of the hearing aid in FIG. 1.

FIG. 2 illustrates a flowchart of a power management routine in a hearing aid according to an embodiment the invention. The power management routine is supposed to be running as a self-contained process independent of the signal processing in the hearing aid. The routine starts in step 201 with power being applied by closing the battery switch in step 202. The power-on step 202 enters a soft-boot call step 203, which in turn leads to a hearing aid program loading step 204. The hearing aid load program step 204 enters a signal processing step 205, which in turn leads to an RC command testing step 206.

The RC command testing step 206 branches out into a negative branch connected to the input of the signal processing step 205, and an affirmative branch connected to a power-down testing step 207. The power-down testing step 207 further branches out into a negative branch connected to a command processing step 208, and an affirmative branch connected to a clock shutdown step 209. The output of the command processing step 208 loops back into step 205 for continued signal processing, and the output of the clock shutdown step 209 is followed by a power-up testing step 210 branching out into a negative branch looping back into the input of the power-up testing step 210 itself, and an affirmative branch leading to a clock turn-on step 211. The output of the clock turn-on step 211 leads back into the input of the soft-boot call step 203.

The starting step 201 and the power-on step 202 in the flowchart in FIG. 2 indicate that power is applied to the hearing aid by the user by placing a battery in the battery compartment of the hearing aid and closing the battery compartment, thereby closing the electric circuit.

When power is initially applied, the power management routine calls the soft-boot subroutine in the soft-boot call step 203. The soft-boot subroutine (not shown) initializes the hearing aid signal processor, loads a set of starting parameters, and prepares the hearing aid processor for loading a specific hearing aid program in the program load step 204. When the specific program is loaded, the signal processor starts to process incoming sound according to the selected program, as specified by the signal processing step 205.

While the signal processor is busy processing signals, the power management routine makes an inquiry at regular intervals in order to detect if an RC command has been received. This inquiry takes place in the RC command testing step 206. If no RC command is received, the power management routine loops back to step 205 and regular signal processing continues uninterrupted. If, however, an RC command has been received, the power management routine investigates the nature of the received command further in the power-down testing step 207. In a preferred embodiment (not shown), the power management routine may be driven by an interrupt vector or the like.

If the received command is not a power-down command, the power management routine hands over further decoding to a command processing subroutine in step 208. This subroutine (not shown) performs the decoding of all other commands received by the hearing aid, and subsequently hands the power management back to the power management routine, which loops back into step 205 after processing the command, which may be a volume change, a program change, or similar type of command.

In the case that the received command is indeed a power-down command, the power management routine continues to step 209, where a signal to shut down the clock signal to the signal processor is issued. This, in turn, brings all signal processing to a halt, thus muting all sound output by the hearing aid and leaving only the RC receiver, the power management routine, and a couple of other vital parts if the hearing aid active, thereby reducing the power consumption considerably. The hearing aid is now effectively in a stand-by mode.

After shutting down the clock signal to the signal processor in step 209, the power management routine then continues to look for a power-up signal by performing a test in order to detect whether a power-on signal from either an external programming device or a command from an RC has been received by the hearing aid. This test is performed in step 210. If the test fails, i.e. no power-up signal is detected, step 210 loops back into itself, performing the test indefinitely until a power-up signal has been detected. If a power-up signal is received, the power management routine continues to step 211 and turns the clock signal for the signal processor back on. The power management routine then promptly proceeds to step 203 and calls the soft-boot subroutine, loads the current program in step 204, whereby the hearing aid leaves the stand-by mode and resumes regular operation in step 205.

In one embodiment of the invention, the power management routine may beneficially be implemented as a logic sub-circuit of the hearing aid controller, thus not necessarily requiring a clock signal itself, but instead relying on a set of logical conditions determining the state of the power management.

Figure 3:
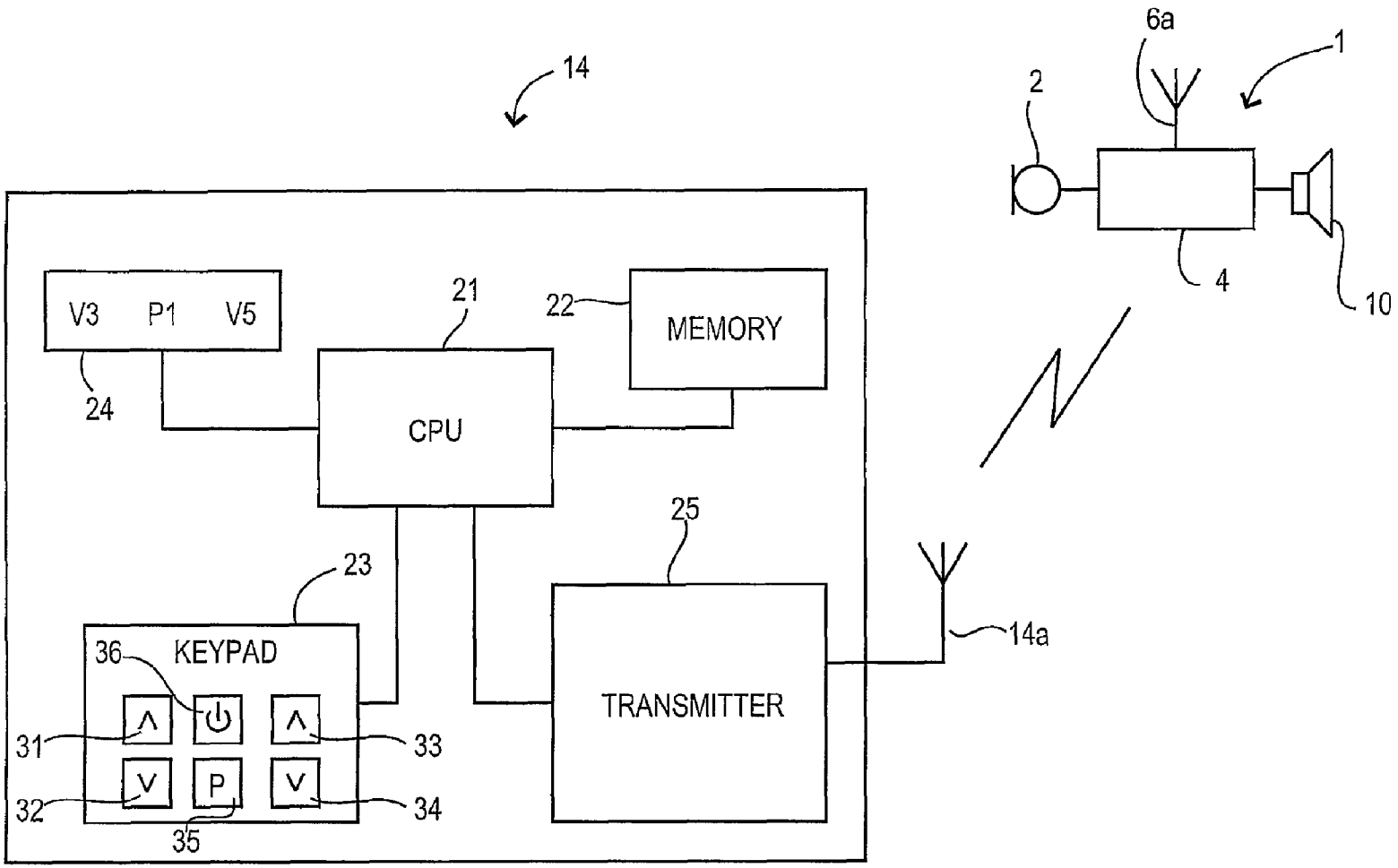
FIG. 3 illustrates a schematic block diagram of a remote control for use with the hearing aid in FIG. 1.

FIG. 3 illustrates a schematic block diagram of a remote control device 14 for use with the hearing aid 1 according to an embodiment of the invention. The remote control device 14 comprises a central processing unit 21, a memory 22, a keypad 23, a display 24, and a transmitter 25 having a transmission antenna 14*a*. The keypad 23 comprises a left volume up key 31, left volume down key 32, a right volume up key 33, a right volume down key 34, a program change key 35, and a stand-by key 36.

The remote control device 14 is adapted for transmitting wireless commands to at least one hearing aid 1, said hearing aid comprising a microphone 2, an output transducer 10, a microelectronic circuit 4 and a reception antenna 6*a*. The keys 31, 32, 33, 34, 35, and 36 of the keypad 23 offer the user a selection of commands, said commands comprising increment or decrement volume level, program change, and a stand-by functionality. The keypad may have some of its keys doubled for the purpose of operating two hearing aids independently, and functionality may be further enhanced by enabling a subordinate set of commands to be accessed, e.g. by pressing a key for more than two or three seconds. In the case of two hearing aids being operated by the remote control device 14, a destination flag is transmitted with some of the commands in order to distinguish between a left and a right hearing aid.

A unique identification code is sent with each command from the remote control device to the hearing aids in order to identify the command to the hearing aids. Only commands having the correct identification code corresponding to the code of the hearing aid are processed, all other commands are ignored. The identification code is established from a pool of identification codes by the fitter of the hearing aid at the time of fitting the hearing aid to the user.

During use, the remote control device 14 may transmit commands to the hearing aid 1 in the following way: The user operates the keypad 23, selecting a desired command, say, the key 32, "Decrease Volume Left". This operation is recognized by a keyboard scan routine in the firmware stored in the memory 22, and a corresponding command is executed by the central processing unit 21. The central processing unit 21 then issues a command to the transmitter 25, which converts and transmits the command as a wireless signal via the antenna 14*a* in a form suitable for reception by the hearing aid 1. The issuing of commands and the resulting status in the hearing aid 1 may preferably be reflected by the display 24 of the remote control device 14, allowing the user to verify that a command was transmitted to the hearing aid 1. Upon reception, detection and decoding of the issued command, the hearing aid 1 essentially performs step 208 of the algorithm sketched out in FIG. 2, in this case decreasing the volume if the hearing aid is set up to be a left hearing aid.

If the user presses the stand-by key 36 on the keypad 23 of the remote control device 14, the corresponding stand-by command is issued to the hearing aid 1. Upon reception of the stand-by command, the power management routine in the hearing aid 1 executes the power-down routine and disconnects its clock signal to the predetermined, signal-processing parts of the hearing aid circuitry within the microelectronic circuit 4, and the hearing aid enters the stand-by mode.

When the clock signal in the microelectronic circuit 4 of the hearing aid 1 is disconnected from the signal-processing parts of the microelectronic circuit 4 upon detection of a power-down command as described in the foregoing, signal processing in the hearing aid 1 is effectively halted. Only the parts of the microelectronic circuit 4 of the hearing aid 1 responsible for reception of remote control commands remain active in the hearing aid 1 while the hearing aid 1 is in stand-by mode.

For the purpose of making the hearing aid 1 leave stand-by mode and re-enter regular operation, a power-up command may be issued to the hearing aid 1 by the user by pressing the key 36 on the keypad 23 of the remote control device 14 again. The wireless receiver of the hearing aid 1 then decodes the command and responds by turning the clock signal back on and issuing a soft-boot command to the hearing aid controller, starting the signal processor up in a controlled state and securing regular operation posterior to the reception of the power-up command.

In an alternate embodiment (not shown), the hearing aid may be put into a stand-by mode by means of a dedicated switch embedded into the hearing aid case and operated by the hearing aid user, thus not depending on the presence of a remote control unit in order to enter or leave a stand-by mode by shutting off the clock signal to the signal processor in the hearing aid.

The invention claimed is:

1. A hearing aid comprising a power source, at least one input transducer, an analog/digital converter, a digital signal processor, a clock generator, an acoustic output transducer, and a remote control receiver, wherein the remote control receiver comprises means for controlling a connection between the clock generator and the digital signal processor to provide changing between a power-on mode and a stand-by mode according to a signal received by the remote control receiver, said means for controlling a connection comprising a controller and a switch, the switch being embodied as a semiconductor switching element, and said controller being adapted to perform a soft-boot sequence on changing from the stand-by mode to the power-on mode.

2. The hearing aid according to claim 1, wherein the remote control receiver and the controller are active in the power-on mode and in the stand-by mode.

3. The hearing aid according to claim 1, wherein the switch is arranged between the clock generator and the digital signal processor for controlling the clock signal to the signal processor.

4. The hearing aid according to claim 1, wherein the clock generator comprises a plurality of clock signal branches, the signal processor having a plurality of sections, each branch connected to a respective section of the signal processor and comprising a controllable switch for controlling the clock signal to the respective section.

5. A method of operating a hearing aid, said method involving the steps of powering on the hearing aid, loading a hearing program into a signal processor, processing a signal according to the hearing program, receiving, decoding and processing a remote control command, responding to a stand-by command from the remote control by entering a stand-by mode, the step of entering the stand-by mode comprising disabling the flow of a clock signal to dedicated parts of the hearing aid, and responding to a power-on command from the remote control by enabling the flow of the clock signal to said dedicated parts of the hearing aid and calling a soft-boot algorithm.

6. A hearing aid system comprising at least one hearing aid and a remote control, which hearing aid has a power source, at least one input transducer, an analog/digital converter, a digital signal processor, a clock generator, an acoustic output transducer, and a remote control receiver having means for controlling a connection between the clock generator and the digital signal processor to provide changing between a power-on mode and a stand-by mode according to a signal received by the remote control receiver, said means for controlling the connection between the clock generator and the digital signal processor including a controller and a switch, the switch being embodied as a semiconductor switching element, said controller being adapted to perform a soft-boot sequence on changing from the stand-by mode to the power-on mode.

7. The hearing aid system according to claim 6, wherein the remote control is adapted for issuing a code with every command for uniquely identifying the hearing aid for which the command is intended.

8. The hearing system according to claim 7, wherein the hearing aid is adapted for decoding commands from the remote control if the code corresponds to the code of the hearing aid.

* * * * *